US005205719A

United States Patent [19]

Childs et al.

[11] Patent Number: 5,205,719

[45] Date of Patent: Apr. 27, 1993

[54] REFRIGERANT COMPRESSOR DISCHARGE MUFFLER

[75] Inventors: Austin S. Childs, Piqua; Hubert Bukac, Sidney; Simon Y. Wang, Tipp City, all of Ohio

[73] Assignee: Copeland Corporation, Sidney, Ohio

[21] Appl. No.: 819,763

[22] Filed: Jan. 13, 1992

[51] Int. Cl.[5] ..... F04B 21/00

[52] U.S. Cl. ..... 417/312; 181/229; 181/403

[58] Field of Search ..... 417/312; 181/224, 229, 181/249, 403

[56] References Cited

U.S. PATENT DOCUMENTS

| | | | |
|---|---|---|---|
| 3,006,160 | 10/1961 | Heidorn | 62/296 |
| 3,144,754 | 6/1963 | Tilden | 62/5 |
| 3,233,698 | 2/1966 | Powers | 181/48 |
| 3,323,305 | 6/1967 | Klees | 60/52 |
| 3,645,358 | 2/1972 | Kubota et al. | 417/312 |
| 3,913,703 | 10/1975 | Parker | 181/44 |
| 3,920,095 | 11/1975 | Clark | 181/42 |
| 4,356,885 | 11/1982 | Dello | 181/227 |
| 4,671,380 | 6/1987 | Henderson et al. | 181/249 |
| 4,745,988 | 5/1988 | Hardt et al. | 181/249 |
| 4,979,587 | 12/1990 | Hirt et al. | 181/213 |

*Primary Examiner*—Richard A. Bertsch
*Assistant Examiner*—Charles C. Freay
*Attorney, Agent, or Firm*—Harness, Dickey & Pierce

[57] ABSTRACT

A refrigerant compressor discharge muffler which operates on the principle of a closed chamber resonator is disclosed. The muffler includes a generally J-shaped tube and an outer shell adapted to be threadably affixed to the head of a motor-compressor unit. The J-shaped tube is partially disposed within the outer shell and has a plurality of arrangements of apertures extending through the wall of the tube interconnecting the internal passage of the tube with a chamber defined by the outer shell. The spacing and size of the apertures are determined by a relationship to a frequency desiring to be attenuated.

11 Claims, 3 Drawing Sheets

REFRIGERANT COMPRESSOR DISCHARGE MUFFLER

BACKGROUND OF THE INVENTION

The present invention relates to mufflers. More particularly the present invention relates to an improved discharge gas muffler for refrigerant compressors.

In the case of refrigerant compressors used for air conditioning and heat pump applications, sound has become an increasingly important criteria for judging acceptability. Accordingly, there is a demand for improved refrigerant compressors which are quieter than those presently available, but sacrificing none of the advantages of existing compressors.

It is therefore a primary objective of the present invention to provide a refrigerant compressor muffler which operates on the principle of a closed chamber resonator. The present invention provides an improved discharge gas muffler which is relatively simple in construction and does not result in a significant loss of efficiency.

From the subsequent detailed description, appended claims and drawings, other objects and advantages of the present invention will become apparent to those skilled in the art.

DESCRIPTION OF THE PREFERRED EMBODIMENT

Figure 1:
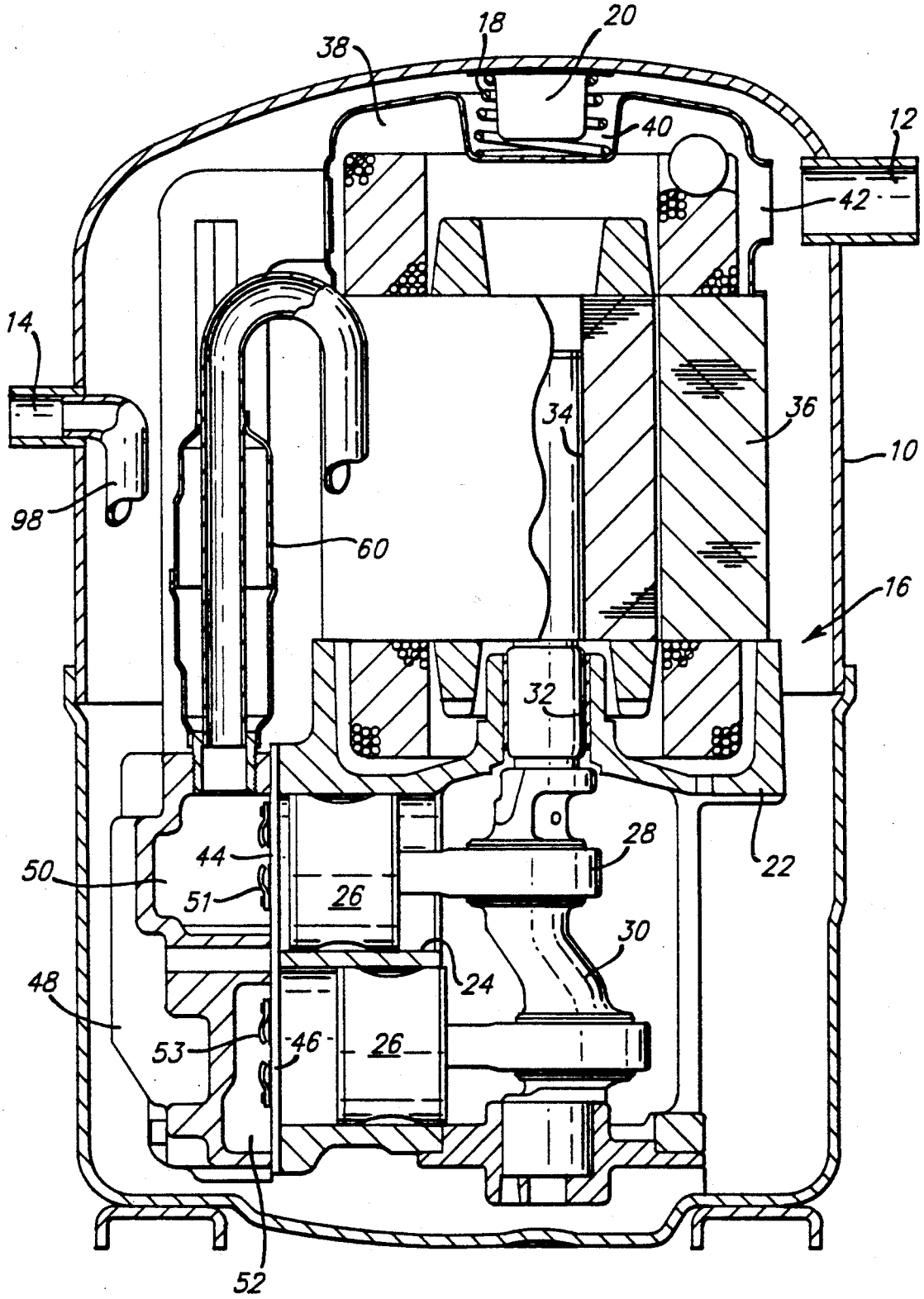
FIG. 1 is a vertical sectional view of a multi-cylinder hermetic refrigerant compressor incorporating a discharge gas muffler embodying the principles of the present invention.

The present invention is illustrated for exemplary purposes embodied in a two cylinder reciprocating compressor. The major components of the compressor include a hermetic shell 10, a suction gas inlet fitting 12, a discharge fitting 14, and a motor-compressor unit 16 disposed therein. The motor-compressor unit is spring supported in the usual manner (not shown) and positioned at the upper end by means of a spring 18 located on a sheet metal projection 20. The motor-compressor unit 16 generally comprises a compressor body 22 defining a plurality of pumping cylinders 24 (two parallel radially disposed cylinders in this case). A reciprocating pumping member is disposed in each of these cylinders in the form of a piston 26 connected in the usual manner by connecting rod 28 to a crankshaft 30. The crankshaft 30 is rotationally journalled in a bearing 32 disposed in body 22. The upper end of crankshaft 30 is affixed to a motor rotor 34 rotatively disposed within a motor stator 36. The upper end of the motor stator is provided with a motor cover 38 which has a recess 40 receiving spring 18 and an inlet opening 42. The inlet opening 42 is positioned to receive suction gas entering through fitting 12 for purposes of motor cooling prior to induction into the compressor. Each cylinder 24 in body 22 is opened to an outer planar surface 44 on body 22 to which is bolted the usual valve plate assembly 46 and cylinder head 48, all in the usual manner. Cylinder head 48 defines interconnected discharge gas chambers 50 and 52 which receive the discharge gas pumped by the compressor through discharge valve assemblies 51 and 53, respectively. Up to this point the compressor as described is known in the art and the essential details thereof are disclosed in the U.S. Pat. No. 4,412,791, the disclosure of which is hereby incorporated herein by reference.

Figure 2:
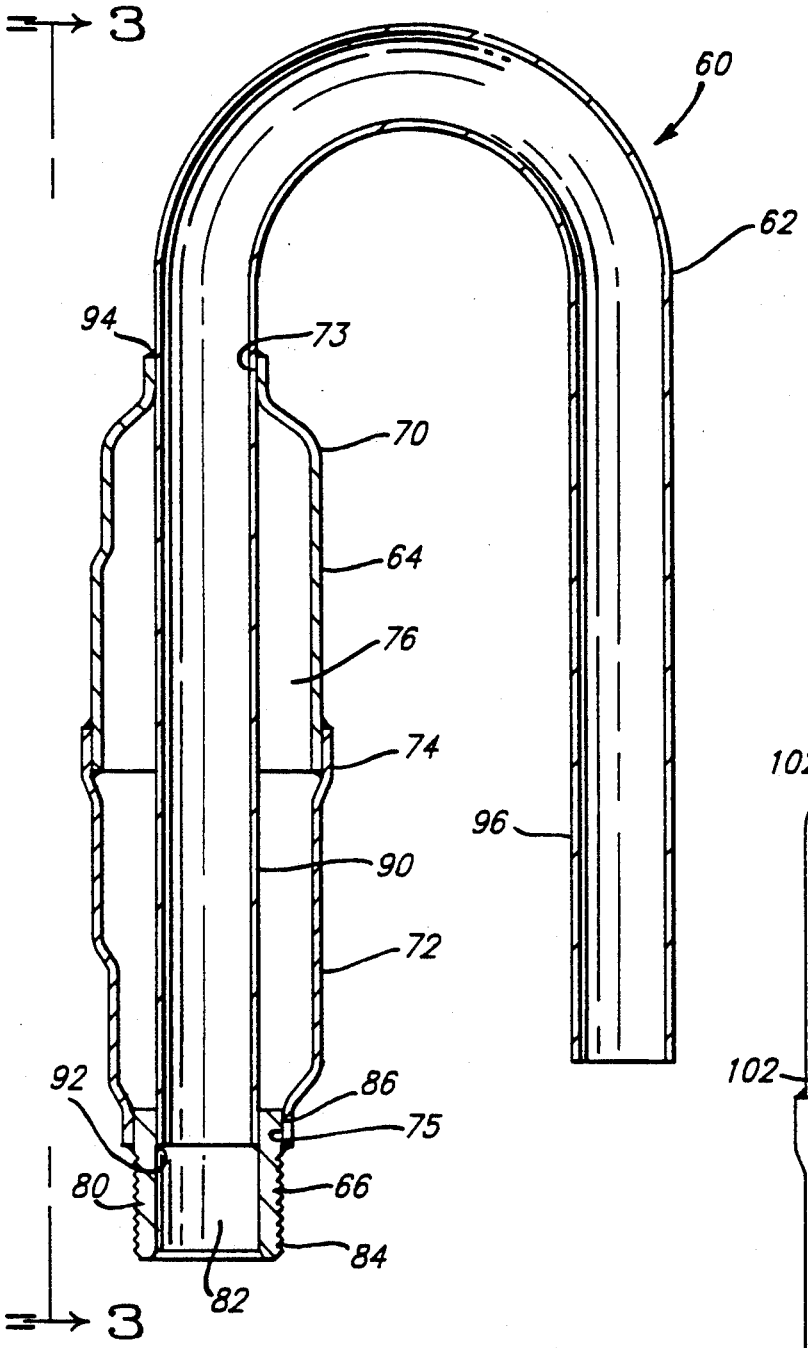
FIG. 2 is an enlarged vertical sectional view of the discharge gas muffler of the present invention.
Figure 3:
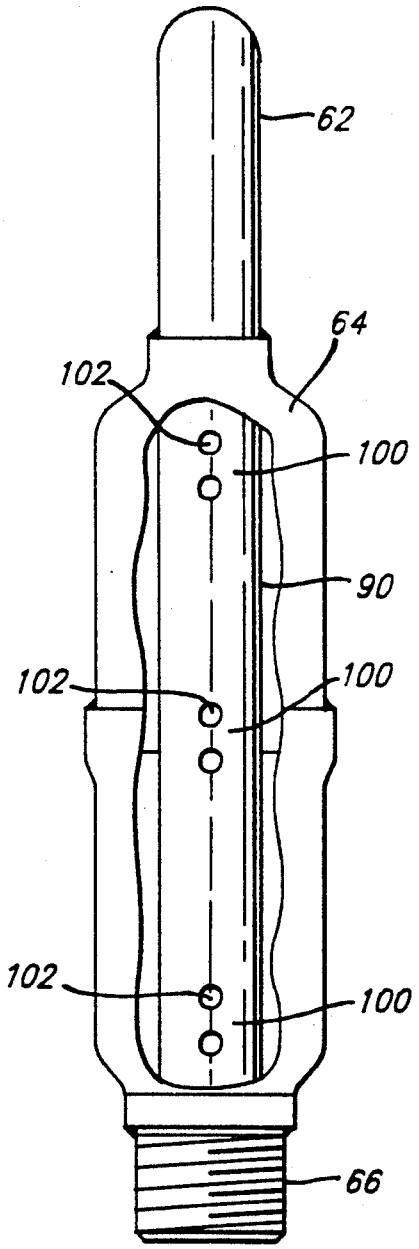
FIG. 3 is a partial sectional view taken in the direction of arrow 3—3 in FIG. 2.

Referring now to FIGS. 2 and 3, the discharge muffler 60 comprises a generally J-shaped discharge tube 62, an outer shell 64 and a fitting 66.

The outer shell 64 comprises an upper portion 70 and a lower portion 72. The upper and lower portions 70, 72 are telescoped and sealingly brazed together at 74 to define an elongated chamber 76 which is of generally circular cross section for stiffness and has a generally circular opening 73 and 75 at each end. The diameters of the circular openings 73 and 75 are not equal and both are smaller than the diameter of the elongated chamber 76.

The fitting 66 has an annular body 80 which defines a cylindrical opening 82 extending through the fitting 66. The inside diameter of the cylindrical opening 82 is substantially the same as the inside diameter of opening 73 and is equal to or slightly less than the outside diameter of the J-shaped tube 62 as will be discussed later herein. The outside surface of the fitting 66 comprises a threaded section 84 and a generally circular section 86. The threaded section 84 is designed to be threadably affixed to head 48 of the motor-compressor unit 16. The generally circular section 86 has a diameter which is equal to or slightly larger than the diameter of opening 75 and is sealingly brazed to one end of the outer shell 66 as shown in FIG. 2.

One side 90 of the J-shaped tube 62 extends through opening 73 of the outer shell, through the elongate chamber 76 and into the cylindrical opening 82 of the fitting 66. The fitting 66 and the outer shell 64 are sealing brazed to J-shaped tube 62 at positions 92 and 94 respectively. The other end 96 of the J-shaped tube 62 extends downwardly under the compressor to the inlet end of a secondary muffler (not shown). The outlet of the secondary muffler is connected via tubing 98 to discharge fitting 14.

The side 90 of the J-shaped tube 62 which is located within elongated chamber 76 has a plurality of arrangements 100 of apertures. Each arrangement 100 includes a plurality of circular holes 102. The size of each hole 102 is determined by a relationship of the size of the hole to the size of the J-shaped tube 62. The total cross sectional area of each arrangement of circular holes 102 is less than 20% of the cross sectional area of the J-shaped tube 62, and each arrangement 100 preferably comprises a pair of equally sized holes 102. The space between adjacent holes is approximately equal to the diameter of the holes. This gives a center line to center line distance between adjacent holes equal to approximately two times the diameter of the hole. While the present invention is being described using circular holes, it is understood that any shape of hole is acceptable as long as the relationships of the cross sectional areas and the spacing are maintained.

Each arrangement of apertures is placed in line axially with the other arrangements of apertures and separated from an adjacent arrangement of apertures by a center to center distance which is equal to approximately one-eighth of the wavelength of the primary frequency to be attenuated. The holes are located axially in line to make it easier to fabricate the tube. Chamber 76 is as large as possible, as dictated by cost and space factors, and has a length which results in an arrangement 100 being located closely adjacent each end of chamber 76. This positioning improves the acoustics of the system as well as providing an oil drain for the elongated chamber when the muffler is positioned vertically.

In designing the muffler, it is first necessary to determine the fundamental harmonic frequency to be attenuated. The frequency components requiring attenuation are determined by actual measurement of the machine in question. First, a plot of discharge pressure versus time is made using a pressure transducer located several feet from an unmuffled compressor in the discharge line with an anechoic termination. This data is then subjected to a conventional Fourier analysis to provide a plot of magnitude of the pressure pulsations versus frequency. This plot will visually reveal the frequencies which are the noisiest and hence require attenuation.

One example of the present invention was developed to attenuate a primary frequency of approximately 600 to 800 hertz, and particularly approximately 630 hertz. This frequency was found to excite both the motor-compressor unit and the condenser unit. The discharge muffler of the present invention is directed towards attenuation of this primary frequency. The secondary muffler positioned downstream of this primary muffler is designed to attenuating other less significant frequencies.

The above referenced example uses a J-shaped tube 62 which is approximately 0.500 inches in diameter (0.196 square inches). Each arrangement of holes 102 comprises two holes. Each hole has a diameter of approximately 0.116 inches (0.011 square inches). Each hole is spaced at a centerline to centerline distance of approximately 0.24 inches. The plurality of arrangements of apertures 100 comprises three sets of the two holes spaced approximately 1.36 inches apart.

Figure 4:
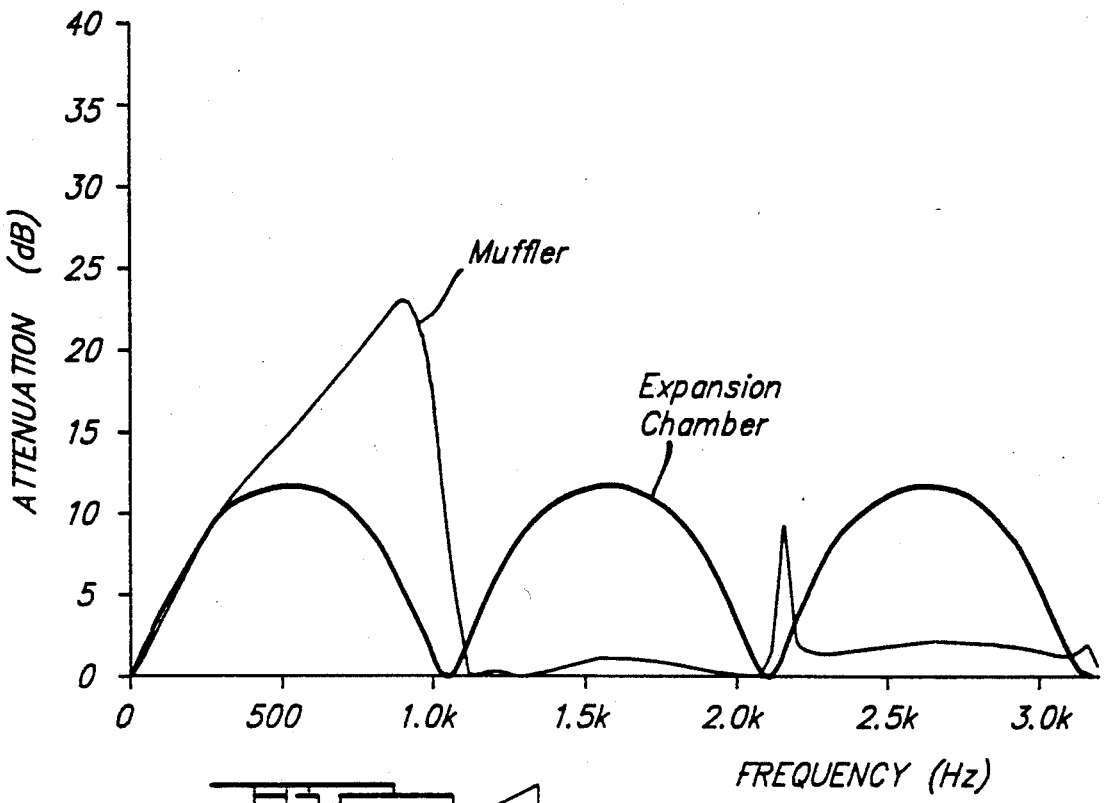
FIG. 4 shows a plot of the amount of attenuation versus the frequency.

This muffler was found to significantly improve the attenuation in the desired frequency range as well as significantly reducing the undesirable build up of back pressure in the discharge chambers 50 and 52 at and over twice the primary frequency. This is demonstrated by the graphs shown in FIGS. 4 and 5. The graph in FIG. 4 shows a plot of the amount of attenuation versus the frequency. The curve marked "Expansion Chamber" represents the attenuation of a typical expansion chamber design of the muffler. The curve marked "Muffler" represents a plot of a muffler in accordance with the present invention. The graph shows that the attenuation in the targeted range of 600–800 hertz or more particularly approximately 630 hertz is significantly improved. The attenuation for frequencies above the primary frequency are accommodated for by the secondary muffler positioned downstream of the primary muffler.

Figure 5:
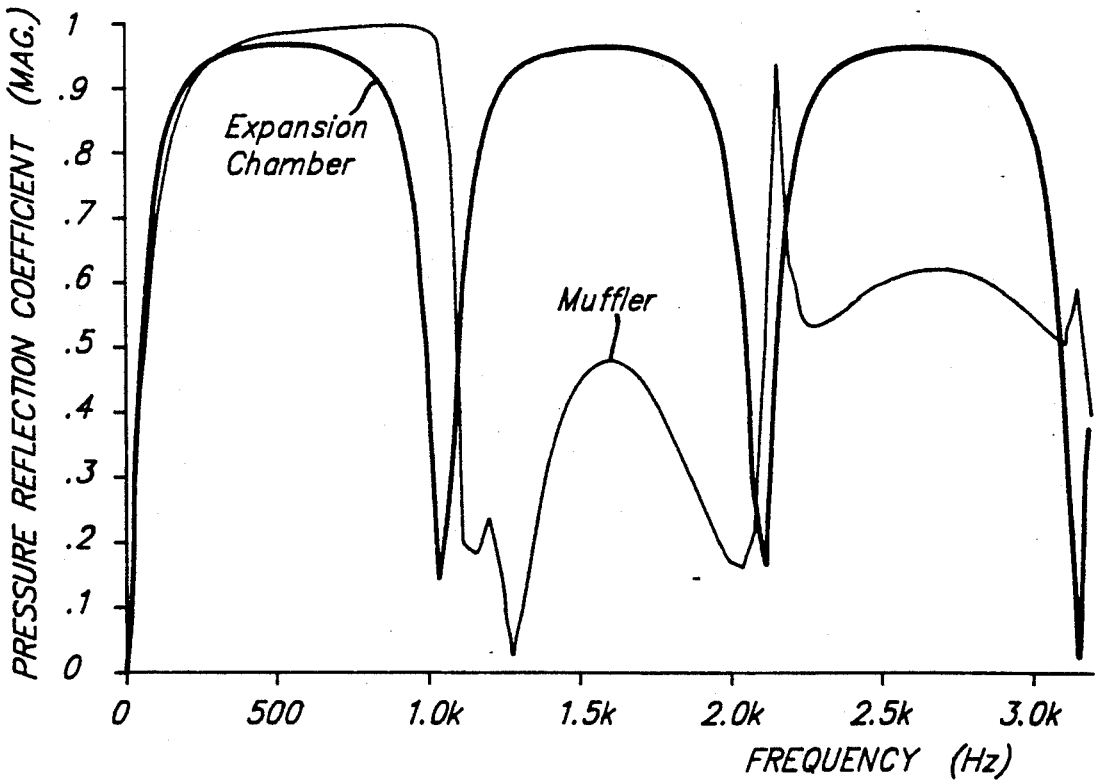
FIG. 5 shows a plot of input pressure reflection coefficient versus frequency.

FIG. 5 shows a similar plot of input pressure reflection coefficient versus frequency. Again, the curve marked "Expansion Chamber" design is a plot for a typical expansion chamber design or muffler and the curve marked "Muffler" is a plot for a muffler in accordance with the present invention. The graph shows a significant decrease in the input pressure reflection at and over twice the primary frequency of approximately 630 hertz. This reduction of back pressure has been found to significantly improve the performance of the refrigerant compressor.

While it will be apparent that the preferred embodiment of the invention disclosed are well calculated to provide the advantages above stated, it will be appreciated that the invention is susceptible to modification, variation and change without departing from the proper scope or fair meaning of the subjoined claims.

What is claimed is:

1. A compressor discharge muffler comprising:

a shell defining a generally cylindrical sound attenuation chamber having a longitudinal axis, said chamber having an inlet opening disposed at a first end of said shell and an outlet opening disposed at a second end of said shell;

a single piece tube disposed within said attenuation chamber and having a center axis, a central passage, an outlet end and an inlet end, said inlet end sealingly connected to said inlet opening for receiving gas entering said muffler, said outlet end sealingly connected to said outlet opening for discharging said gas from said muffler, said tube being straight with said center axis of said tube extending generally parallel to said longitudinal axis of said shell; and means defining a plurality of spaced arrangements of apertures through the wall of said tube, each arrangement of apertures being spaced a specified distance from adjacent arrangements of apertures, each arrangement of apertures comprising a plurality of apertures extending generally perpendicular to said center axis of said tube, each aperture of said plurality of apertures connecting said attenuation chamber to said central passage of said tube.

2. The compressor discharge muffler of claim 1 wherein said shell is formed of a first cup shaped member having said inlet opening at a first end and a second open end defining a first peripheral edge, and a second cup-shaped member having said outlet opening at a first end and a second open end defining a second peripheral edge, said first and second peripheral edges being connected together in a sealing relationship.

3. The compressor discharge muffler of claim 1 wherein said tube is of uniform cross-section throughout its length in said chamber.

4. The compressor discharge muffler of claim 3 wherein each arrangement of apertures has a total cross sectional area which is equal to or less than 20% of the cross sectional area of said central passage of said tube.

5. The compressor discharge muffler of claim 1 wherein each aperture of said plurality of apertures is positioned along a line which is generally parallel to said central axis of said tube.

6. The compressor discharge muffler of claim 1 wherein said specified distance is equal to ⅛ the wavelength of a frequency chosen to be attenuated.

7. The compressor discharge muffler of claim 1 wherein said plurality of apertures comprises a pair of holes.

8. The compressor discharge muffler of claim 7 wherein said pair of holes are circular.

9. The compressor discharge muffler of claim 8 wherein said pair of holes have a centerline to centerline distance equal to two times the diameter of said hole.

10. The compressor discharge muffler of claim 1 wherein there are three of said arrangements of apertures.

11. The compressor discharge muffler of claim 10 wherein said specified distance is equal to ⅛ the wavelength of a frequency chosen to be attenuated.

* * * * *